US007894747B2

(12) United States Patent
Hisada

(10) Patent No.: US 7,894,747 B2
(45) Date of Patent: Feb. 22, 2011

(54) IMAGE FORMING APPARATUS WITH EXPOSURE UNITS

(75) Inventor: Hidenori Hisada, Tokoname (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 12/750,008

(22) Filed: Mar. 30, 2010

(65) Prior Publication Data

US 2010/0183352 A1 Jul. 22, 2010

Related U.S. Application Data

(63) Continuation of application No. 12/109,632, filed on Apr. 25, 2008, now Pat. No. 7,715,753.

(30) Foreign Application Priority Data

Apr. 27, 2007 (JP) ..... 2007-118042

(51) Int. Cl.
*G03G 15/01* (2006.01)
*G03G 21/16* (2006.01)

(52) U.S. Cl. ..... 399/110; 399/111; 399/125

(58) Field of Classification Search ..... 399/110, 399/112, 111, 125
See application file for complete search history.

(56) References Cited

U.S. PATENT DOCUMENTS 5,333,036 A 7/1994 Koga
7,388,593 B2 6/2008 Fukuda
2001/0021321 A1 9/2001 Kikuchi et al.
2006/0067734 A1 3/2006 Igarashi et al.
2006/0140669 A1 6/2006 Sato
2006/0222402 A1 10/2006 Sato et al.
2006/0251446 A1 11/2006 Okabe et al.
2007/0048005 A1 3/2007 Nakano et al.
2007/0071494 A1 3/2007 Igarashi et al.
2008/0175620 A1 7/2008 Ohta et al.

FOREIGN PATENT DOCUMENTS

JP 10-187002 7/1998
JP 11-155034 6/1999
JP 2003-112446 A 4/2003
JP 2004-206021 A 7/2004
JP 2006-098772 4/2006

*Primary Examiner*—Sophia S Chen
(74) *Attorney, Agent, or Firm*—Banner & Witcoff, Ltd.

(57) ABSTRACT

In an image forming apparatus, a plurality of process units each including a photoconductor drum are arranged in tandem; a plurality of exposure units configured to expose the photoconductor drum to light are each disposed above and opposite to the corresponding photoconductor drum; an output tray configured to receive an ejected recording sheet on which an image has been formed is disposed above the plurality of exposure units; and an image reader unit configured to read an image of a source document is disposed above the output tray with a predetermined space provided between the image reader unit and the output tray.

5 Claims, 4 Drawing Sheets

IMAGE FORMING APPARATUS WITH EXPOSURE UNITS

CROSS-REFERENCE TO RELATED APPLICATION(S)

This application is a continuation of U.S. application Ser. No. 12/109,632 filed Apr. 25, 2008, now U.S. Pat. No. 7,715,753, issued May 11, 2010, which claims the foreign priority benefit under Title 35, United States Code, §119 (a)-(d), of Japanese Patent Application No. 2007-118042, filed on Apr. 27, 2007 in the Japan Patent Office, the disclosures of which are herein incorporated by reference in their entirety.

BACKGROUND

1. Field

One or more aspects of the present invention relate to an image forming apparatus which includes a plurality of exposure units using, for example, a light-emitting diode or LED, electroluminescent device, etc. as a light source for forming an electrostatic latent image on a photoconductor.

2. Description of Related Art

Typically, printers and digital copying machines of the LED type, as image forming apparatuses, are configured to emit LED light corresponding to image data, which is created from source data as a target to be printed, onto a photoconductor to form an electrostatic latent image on the photoconductor. Toner is supplied from a process unit to the electrostatic latent image on the photoconductor to form a toner image. The toner image is then transferred onto a sheet (of paper, for example) and fixed thereon by heat.

This type of image forming apparatus should have an LED unit for emitting LED light arranged close to an opposed photoconductor, and thus a multicolor image forming apparatus of the LED type, in particular, typically includes a plurality of LED units provided such that each LED unit is arranged between adjacent process units. Therefore, the apparatus configured in this way is unable to realize easy-replaceable process unit configuration as disclosed in JP 2006-98772 A (see FIG. 2; the corresponding U.S. Patent Application is laid open under Publication No. US 2006/0067734 A1) wherein the process units of an image forming apparatus are replaceable in a simple operation of pulling frontward the process units out of the image forming apparatus.

On that account, for example, JP 10-187002 A (see FIG. 1) discloses an image recording apparatus wherein an upper cover to which LED units are mounted, is opened upwardly to a position in which the upper cover forms an angle of approximately 90 degrees with a main body of the apparatus so as to form an opening at an upper side of the main body of the apparatus and each process unit is removed upward through the opening for replacement.

In order to swing the large upper cover with the LED units mounted thereto open through a full 90 degrees, an ample space should be provided behind and/or above of the apparatus. Thus, the apparatus would disadvantageously suffer from severe limitations on its installation location. Moreover, as is often the case with such an apparatus, an image reader unit for reading image data may be mounted on the top of the apparatus, and in such an instance the upper cover is provided integrally with the LED units and the image reader unit, which would disadvantageously render the upper cover rather heavy, unstable, and detrimental to its handleability.

One or more aspects of the present invention have been made in an attempt to eliminate the above disadvantages.

Illustrative, non-limiting embodiments of the present invention overcome the above disadvantages and other disadvantages not described above. Also, each aspect or embodiment of the present invention is not required to overcome the disadvantages described above, and an illustrative, non-limiting embodiment of the present invention may not overcome any of the problems described above.

SUMMARY

It is one aspect of the present invention to provide an image forming apparatus in which limitations on its installation location are reduced and a process unit can be replaced with increased ease.

More specifically, in one aspect of the present invention, there is provided an image forming apparatus, which comprises a plurality of process units, a plurality of exposure units, an output tray, and an image reader unit. The plurality of process units are arranged in tandem, and each process unit comprises a photoconductor drum. Each of the plurality of exposure units is disposed above and opposite to the corresponding photoconductor drum, and configured to expose the photoconductor drum to light, thereby forming an electrostatic latent image thereon. The output tray is disposed above the plurality of exposure units, and configured to receive an ejected recording sheet on which an image has been formed. The image reader unit is disposed above the output tray with a predetermined space provided between the image reader unit and the output tray, and is configured to read an image of a source document. At least one of the exposure units and at least a part of the output tray are movable together into the predetermined space, whereby the plurality of process units are allowed to be pulled out in a direction of tandem arrangement thereof.

According to the image forming apparatus as configured above, at least one of the exposure units is movable together with a part of the output tray into the predetermined space provided between the image reader unit and the output tray, and therefore, the at least one of the exposure units may be moved out from between the adjacent process units inside the apparatus. This configuration makes it possible to pull out the plurality of process units in the direction of its tandem arrangement.

Moreover, in this configuration, the image reader unit provided above the output tray in the image forming apparatus need not be moved, and the only thing a user should do in order to pull the process units out is to move at least one of the exposure units and at least a part of the output tray together into the predetermined space provided between the output tray and the image reader unit. This provides an improved handleability, and saves space at a behind and/or above the apparatus.

According to an embodiment of the present invention, the plurality of process units can be allowed to be pulled out in a direction of its tandem arrangement. Therefore, the process units can be replaced with increased ease. Furthermore, as no ample space is required at a rear and/or upper side of the apparatus, the limitation on its installation location can be reduced.

BRIEF DESCRIPTION OF THE DRAWINGS

The above aspects, other advantages and further features of the present invention will become more apparent by describing in detail illustrative, non-limiting embodiments thereof with reference to the accompanying drawings, in which.

DETAILED DESCRIPTION

First Embodiment

Figure 1:
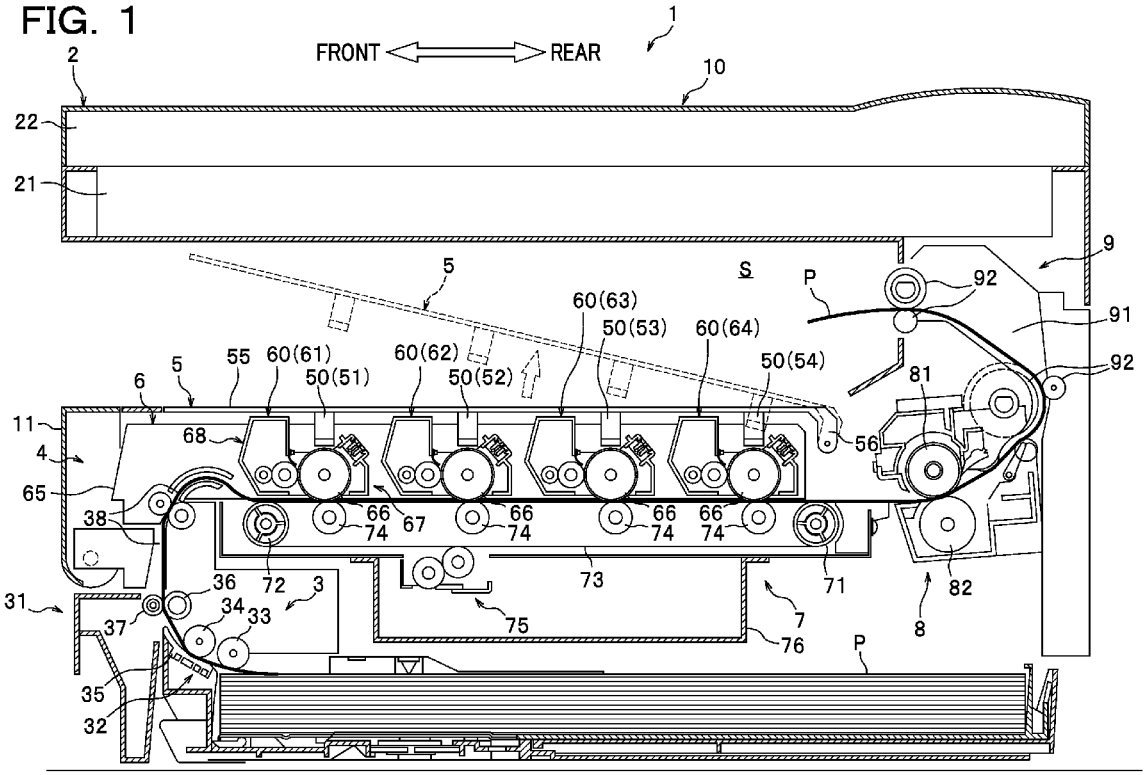
FIG. 1 is a schematic vertical sectional view of a multicolor and multifunction printer as an image forming apparatus according to a first embodiment of the present invention.

A detailed description will be given of a first embodiment of the present invention with reference to the drawings. In the following description, the left side of the drawing figures is the front side of a multicolor and multifunction printer (image forming apparatus), and the right side is the rear side thereof.

As shown in FIG. 1, a multicolor and multifunction (or all-in-one) printer 1 principally includes, within a main body 10, an image reader unit 2, a sheet feeder unit 3, an image forming unit 4 and a sheet output unit 9. The image reader unit 2 is configured to read an image formed on a source document. The sheet feeder unit 3 is configured to feed a sheet P of paper (as an example of a recording sheet) to the image forming unit 4. The image forming unit 4 is configured to form an image on the sheet P fed by the sheet feeder unit 3. The sheet output unit 9 is configured to eject the sheet P on which an image is formed by the image forming unit 4.

Figure 2:
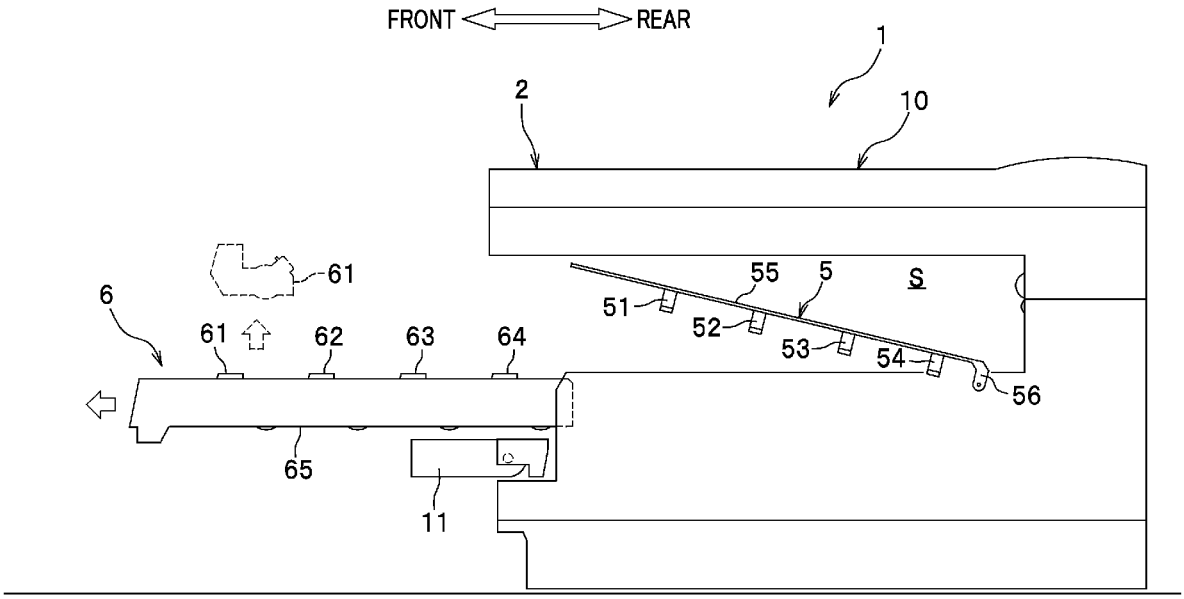
FIG. 2 is a vertical sectional view of the printer of FIG. 1 with a plurality of process units pulled out of a body casing of the printer.

At the front side of the main body 10 (image forming unit 4), an openable front cover 11 is provided so as to swing open forward and closed backward about a supporting axis located in a lower portion of the front cover 11 (see FIG. 2). Through an opening formed when the front cover 11 is opened, a frame 65 provided with process units 60, which will be described later, can be pulled out of the main body 10 toward the front. The units and elements of the multicolor and multifunction printer 1 are described hereinbelow.

Image Reader Unit 2

The image reader unit 2 which makes up an upper portion of the main body 10 is disposed with a space S provided between the image reader unit 2 and an output tray 55. The image reader unit 2 principally includes a document stage 21 and a document pressure plate 22. The image reader unit 2 is joined with a lower portion of the main body 10, which includes the sheet feeder unit 3 and the image forming unit 4, at the rear portion of the main body 10.

Inside the document stage 21, an image sensor (not shown), which has a plurality of photodiodes provided in series, is incorporated. The document pressure plate 22 is mounted to the main body 10 in such a manner that the document pressure plate 22 can be swung upwardly and swung back downwardly with respect to the main body 10 about its supporting axis located on one end at its right, left, or rear side of the multicolor and multifunction printer 1.

In the image reader unit 2 constructed as described above, a document is placed with its image face (i.e., a side on which an image is formed) facing the document stage 21, between the document stage 21 and the document pressure plate 22, and is illuminated with light from the photodiodes, to read the image from the document and create image data from the read image.

It is understood that a document feeder tray and a document output tray may be provided to the document pressure plate 22 of the image reader unit 2 so that an image can be read from a document without opening and closing the document pressure plate 22.

Sheet Feeder Unit 3

The sheet feeder unit 3 is provided in the lower portion of the main body 10, and includes a sheet feed tray 31 detachably attached to the main body 10 and a sheet feed mechanism 32 configured to convey a sheet P from the sheet feed tray 31 to the image forming unit 4.

The sheet feed mechanism 32 is provided in a front portion of the sheet feed tray 31, and principally includes a sheet feed roller 33, a separation roller 34 and a separation pad 35. With this configuration, sheets P in the sheet feed tray 31 are separated from each other and fed upward one after another.

Each sheet P fed upward passes between a paper powder remover roller 36 and a pinch roller 37 to remove paper powder therefrom, and after removal of the paper powder, the sheet P passes along a conveyance path 38 in which the direction of conveyance is changed to a rearward direction, and is then fed onto a conveyor belt 73.

Image Forming Unit 4

The image forming unit 4 includes an exposure section 5, a process section 6, a transfer section 7 and a fixing section 8.

<Exposure Section 5>

The exposure section 5 is provided near the center of the main body 10, and includes a plurality of (e.g., four, in this embodiment) LED units 50 (exposure units) configured to emit LED light to corresponding photoconductor drums 66, and an output tray 55 to which the plurality of LED units 50 are mounted.

The LED units 50 are disposed above and opposite to the corresponding photoconductor drums 66 of four process units 60 having toner for cyan, magenta, yellow and black, respectively. In the present embodiment below, the foremost LED unit may be designated by reference numeral 51, the following LED units by reference numerals 52, 53 in this sequence, and the rearmost LED unit may be designated by reference numeral 54, in the front-rear direction, for convenience of explanation. In the present embodiment, each LED unit 50 includes a plurality of LEDs (luminescent elements) arranged in an array.

The output tray 55 is a tray onto which sheets P ejected from the main body 10 are accumulated, and includes a pair of hinge portions 56 (only one hinge portion 56 is shown in the drawing figures) provided at the right and left ends of the rear side of the output tray 55. The right and left hinge portions 56 of the output tray 55 are rotatably mounted on the outer surfaces of the right and left sides of the main body 10 (see FIG. 2), so that the output tray 55 is swingable upward and downward.

It is to be understood that the mechanism which allows the output tray 55 to be opened or closed according to the present invention is not limited to any specific embodiment. For example, a pneumatic or hydraulic damper device may be provided at the right and left ends (or either one of the ends) of the front side of the output tray 55, to render the output tray 55 mechanically swingable upward and downward. In one embodiment, the output tray 55 may be fixed at its front end by means of a hook provided at the underside of the image reader unit 2, after the output tray 55 is manually swung upward.

In the exposure section 5 configured as described above, when an image forming process is carried out, each LED unit 50 emits LED light to the corresponding photoconductor drum 66 based upon image data corresponding to the colors of cyan, magenta, yellow and black. On the other hand, when any of the process units 60 is to be replaced, the LED units 50 are swung (moved) upward together with the output tray 55, and moved away from the process units 60.

<Process Section 6>

The process section 6 is disposed between the exposure section 5 and the transfer section 7, and includes the plurality of (e.g. four in this embodiment) process units 60 arranged in tandem, and the frame 65 to which each process unit 60 is removably installed. Each process unit 60 includes a photoconductor cartridge 67 containing the photoconductor drum 66, and a development cartridge 68 to be installed in the photoconductor cartridge 67. The process units 60 are different from one another solely in color of toner within the respective development cartridges 68, and have substantially the same construction.

The photoconductor cartridge 67 principally includes the rotatably supported photoconductor drum 66 and a scorotron charger (shown without reference numerals). The development cartridge 68 principally includes a development roller, a doctor blade (for regulating a toner layer thickness), a supply roller and a toner hopper (all shown without reference numerals).

In the present embodiment below, the foremost process unit will be designated by reference numeral 61, the following process units by reference numerals 62, 63 in this sequence, and the rearmost process unit may be designated by reference numeral 64, in the front-rear direction, for convenience of explanation. The LED units 51, 52, 53 and 54 are disposed opposite to the photoconductor drums 66 of the process units 61, 62, 63 and 64, respectively.

The frame 65 is a substantially rectangular box elongated in the front-rear direction, and has in its inside installation spaces (not shown) in which the process units 60 are installed. The bottom of each installation space is partially open to expose the photoconductor drum 66 of the process unit 60 as installed. The frame 65 is attached to the main body 10 in such a manner that it can be pulled out toward the front through the opening formed when the front cover 11 is opened (see FIG. 2).

In the process section 6 configured as described above, when the image forming process is carried out, an electrostatic latent image based upon image data is formed on the photoconductor drum 66 by LED light emitted from the exposure section 5, and toner is supplied from the development cartridge 68 to this electrostatic latent image so that a toner image is retained on the photoconductor drum 66.

At this stage of the image forming process, the LED units 51, 52 and 53 are arranged between the development cartridges 68 of the process units 61 and 62, between the development cartridges 68 of the process units 62 and 63, and between the development cartridges 68 of the process units 63 and 64, respectively. The LED unit 54 is arranged between the development cartridge 68 and the photoconductor cartridge 67 of the process unit 64. In this arrangement, therefore, even when the front cover 11 is opened, the LED units 50 constitute obstacles to the movement of the frame 65, which would make the frame 65 unable to be pulled out frontward.

According to the present embodiment, when any process unit 60 is to be replaced, the LED units 50 are moved upward so that the obstacles (LED units 50) are removed from between adjacent development cartridges 68 of the process units 61, 62, 63 and 64 and between the development cartridge 68 and the photoconductor cartridge 67 of the process unit 64. As a result, the frame 65 is allowed to be pulled out frontward.

Hereupon, the amount of swinging of the output tray 55 may preferably be set such that the output tray 55 is swung open until the lowest edge of the LED unit 53 that is arranged in the second place counted from the rearmost unit in the main body 10 comes to a position, immediately above the highest edge of the process unit 64, in which the LED unit 53 never touches the process unit 64 when the frame 65 is pulled out frontward. In other words, it may be deemed preferable that the output tray 55 be moved to such a degree that three LED units 51, 52 and 53 are entirely accommodated in the space S though the LED unit 54 is not entirely accommodated in the space S (see broken lines in FIG. 1). With this setting, the amount (stroke) of swinging of the output tray 55 can be minimized, and thus the space S can be minimized. Accordingly, the multicolor and multifunction printer 1 may be rendered compact in size.

<Transfer Section 7>

The transfer section 7 includes a driving roller 71, a driven roller 72, a conveyor belt 73, transfer rollers 74 and a cleaning unit 75.

The driving roller 71 and the driven roller 72 are arranged apart from and parallel to each other, and the conveyor belt 73 made up of an endless belt is looped around the driving roller 71 and the driven roller 72. The conveyor belt 73 has its outer face kept in contact with each photoconductor drum 66. On the inner side of the conveyor belt 73 are provided four transfer rollers 74 arranged adjacent to the photoconductor drums 66 respectively so that the conveyor belt 73 is held between the transfer rollers 74 and the corresponding photoconductor drums 66. A transfer bias is applied to the transfer rollers 74 by a constant current control during a transfer operation.

In the transfer section 7 configured as described above, during the image forming process, a sheet P conveyed on the conveyor belt 73 is passed between the photoconductor drums 66 and the transfer rollers 74 disposed on the inner side of the conveyor belt 73, and a toner image carried on each of the photoconductor drums 66 is thus transferred onto the sheet P.

The cleaning unit 75 is disposed under the conveyor belt 73, and configured such that toner adhering to the conveyor belt 73 is removed from the conveyor belt 73, and dropped into a toner reservoir 76 disposed under the cleaning unit 75.

<Fixing Section 8>

The fixing section 8 is disposed downstream from the process section 6 and the transfer section 7 in the conveyance direction, that is, in the rear portion of the main body 10, and includes a heating roller 81 and a pressure roller 82 that is disposed opposite to the heating roller 81 and configured to press the heating roller 81. Inside the heating roller 81, a halogen lamp (not shown) is provided to heat the surface of the heating roller 81 to a predetermined temperature at which toner is melt and fixed onto the sheet P.

In the fixing section 8 configured as described above, the toner image transferred on the sheet P is fixed by heat while the sheet P is passed between the heating roller 81 and the pressure roller 82.

Sheet Output Unit 9

In the sheet output unit 9, a sheet output side conveyor path 91 for the sheet P extends upward from an exit of the fixing section 8 of the image forming unit 4 and then turns toward the front. At some midpoints of the sheet output side conveyor path 91 are disposed a plurality of conveyor rollers 92 configured to convey a sheet P.

A sheet P on which an image is formed is ejected by the sheet output unit 9 into the space S formed between the image reader unit 2 and the output tray 55, and accumulated on the output tray 55.

The next discussion is directed to an operation of the multicolor and multifunction printer 1 configured as described above which is to be carried out when any of the process units 60 is replaced. FIG. 2 is a vertical sectional view of the printer, in which the process units are pulled out from a body casing of the printer.

When the multicolor and multifunction printer 1 is in the process of forming an image, the LED units 51, 52 and 53 are disposed between the development cartridges 68 of the process units 61 and 62, between the development cartridges 68 of the process units 62 and 63, and between the development cartridges 68 of the process units 63 and 64, respectively, and the LED unit 54 is disposed between the development cartridge 68 and the photoconductor cartridge 67 of the process unit 64.

Beginning with this state, first, the output tray 55 is swung upward and the LED units 51, 52 and 53 in their entirety and the LED unit 54 in part which are mounted to the output tray 55 are moved into the space S formed between the image reader unit 2 and the output tray 55, as indicated by broken lines in FIG. 1. As a result, the lowest edge of the LED unit 53 is positioned above the highest edge of the process unit 60 (i.e., the top surface of the development cartridge 68). Moreover, the lowest edge of the LED unit 54 is positioned above the highest edge of the photoconductor cartridge 67 of the process unit 64.

Next, with the output tray 55 retained in the upward position, the front cover 11 is opened and the frame 65 is pulled out toward the front, as shown in FIG. 2. During this operation, the LED units 50 cause no obstruction on the path along which the frame 65 is pulled out because the lowest edge of the LED unit 53 is positioned above the highest edge of the process unit 60 and the lowest edge of the LED unit 54 is above the highest edge of the photoconductor cartridge 67 of the process unit 64.

Then, with the frame 65 retained in the pulled-out position, the process units 60 (61-64) are allowed to be removed upwardly for replacement.

According to the present embodiment as described above, the following advantageous effects can be achieved.

The multicolor and multifunction printer 1, in which the LED units 50 are movable into the space S between the output tray 55 and the image reader unit 2, allows the LED units 50 (exposure section 5) to move away from between the process units 60 (process section 6) within the main body 10. This resultantly allows the process units 60 (process section 6) to be pulled out frontward, so that the replacement of any of the process units 60 can be carried out with increased ease.

In the multicolor and multifunction printer 1 according to the present embodiment, the output tray 55 to which the LED units 50 are mounted is not integrally fixed to the image reader unit 2, and thus is designed to have a relatively light weight, which in turn contributes to its improved stability and better handleability in its swinging operation. Furthermore, in an embodiment where the damper device is provided to swing the output tray 55 upward and downward, for example, as described above, the handleability in operation can be improved more.

Also in the multicolor and multifunction printer 1 according to the present embodiment, the LED units 50 and the output tray 55 are configured to be movable merely into the space S within the main body 10, so that the range of movement of the output tray 55 is narrow and no larger space is required at the rear or upper side of the body casing 10. Thus, the limitation on the installation location of the multicolor and multifunction printer 1 can be reduced.

Second Embodiment

A second embodiment of the present invention will be described in detail with reference to the drawings. Since the second embodiment is a modification of the first embodiment wherein the configuration of the multicolor and multifunction printer 1 described above is partially changed, the same elements will be designated by the same reference numerals and duplicate description thereof will be omitted.

Figure 3:
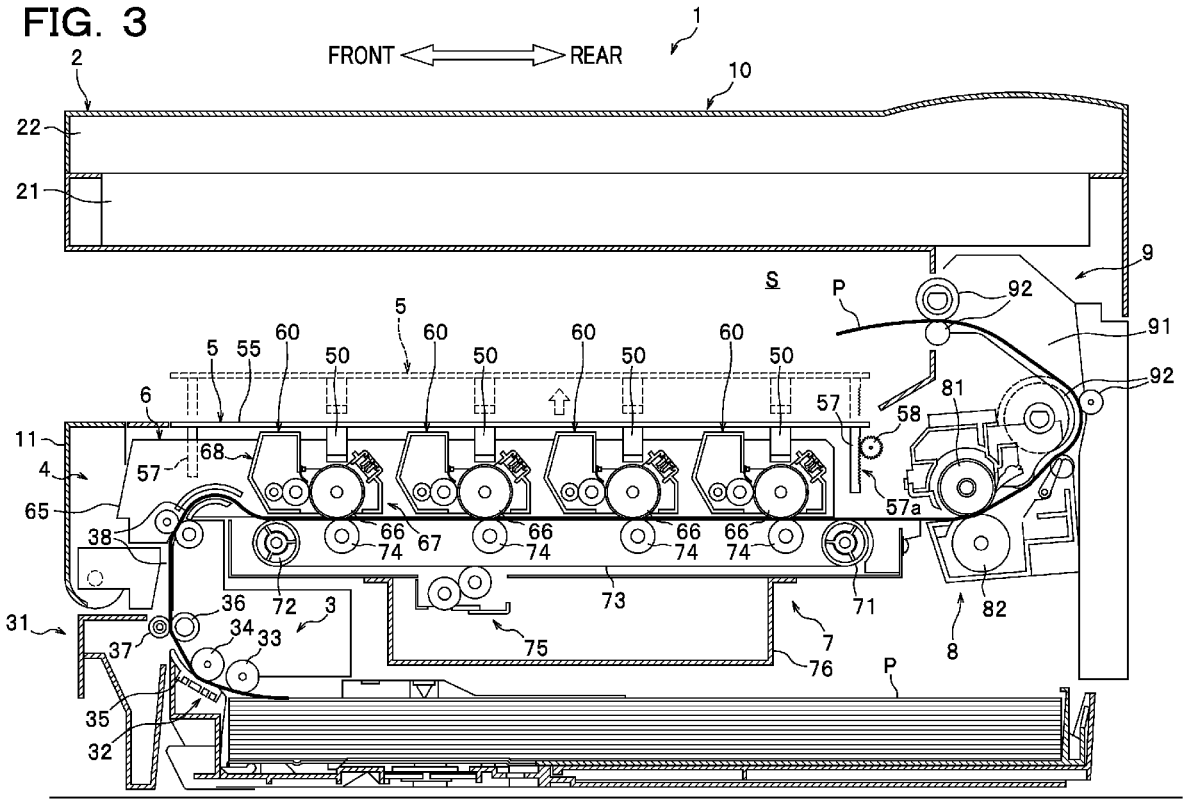
FIG. 3 is a schematic vertical sectional view of a multicolor and multifunction printer as an image forming apparatus according to a second embodiment of the present invention.

In the drawing figures to which a reference will be made, FIG. 3 is a schematic vertical sectional view of a multicolor and multifunction printer according to the second embodiment.

As shown in FIG. 3, the output tray 55 is a tray on which sheets P ejected from the main body 10 are to be accumulated, and to which a plurality of (e.g. four in this embodiment) LED units 50 are mounted. Four support rods 57 (two of which are not shown) are coupled at their upper ends to four spots near both ends of front and rear sides of the output tray 55, respectively. The lower ends of the support rods 57 are inserted into the inside of the main body 10.

At least one of these four support rods 57 has a rack portion 57*a* formed at its side.

The rack portion 57*a* is engaged with a pinion 58. The pinion 58 is connected with a motor (not shown), and as the pinion 58 rotates by the rotational motion produced by the motor, the support rod 57 having the rack portion 57*a* engaged with the pinion 58 moves upward and downward.

Figure 4:
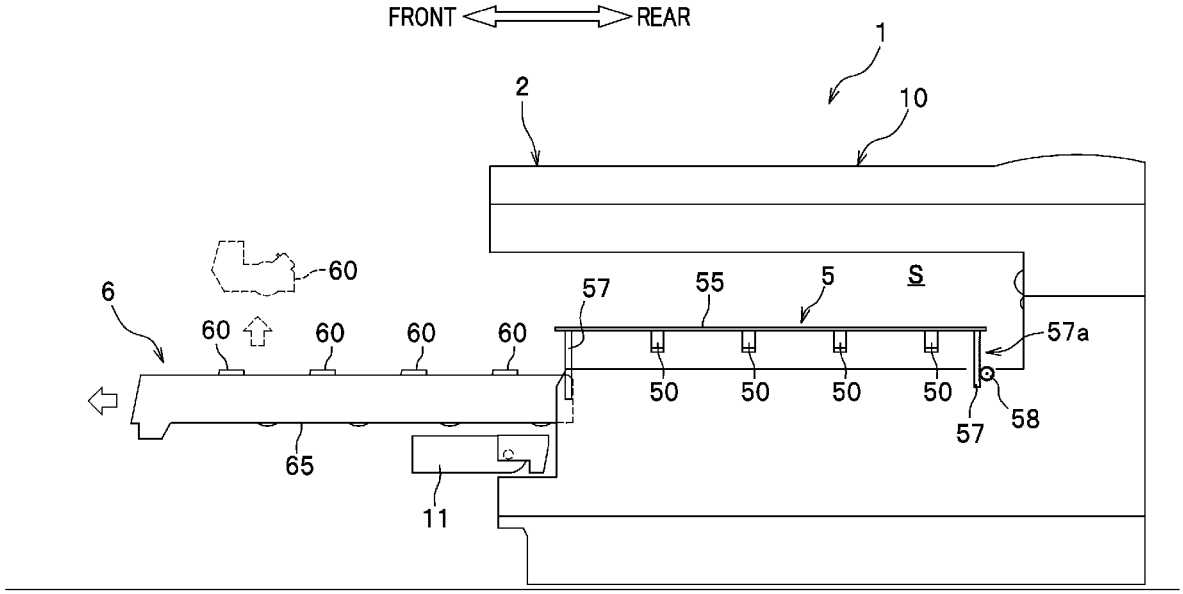
FIG. 4 is a vertical sectional view of the printer of FIG. 3 with a plurality of process units pulled out of a body casing of the printer.

A description will be given of an operation to be performed in the multicolor and multifunction printer 1 configured as described above according to the second embodiment of the present invention when any of the process units 60 is replaced. FIG. 4 is a vertical sectional view of the printer, in which the process units are pulled out from a body casing of the printer.

When the multicolor and multifunction printer 1 is in the process of forming an image, the LED units 50 of the exposure section 5 are disposed above and opposite to the corresponding photoconductor drums 66, as indicated by solid lines in FIG. 3.

In this state, even when the front cover 11 is opened, the frame 65 cannot be pulled out because the LED units 50 interfere with the development cartridges 68 of the process units 60 that are located immediately behind the LED units 50, respectively.

For this reason, first, the pinion 58 is rotated by the rotational motion produced rotates by the motor (not shown) and the support rod 57 having the rack portion 57*a* engaged with the pinion 58 is moved upward, so that the output tray 55 coupled to the support rod 57 is translated upward into the space S as indicated by broken lines in FIG. 3. Consequently, the LED units 50 mounted to the output tray 55 are moved into the space S.

In this state, the lowest edge of the LED units 50 is positioned above the highest edge of the process units 60 (i.e., the top surfaces of the development cartridges 68), and the frame 65 is allowed to be pulled out to the front when the front cover 11 is opened, as shown in FIG. 4. Then, with the frame 65 pulled out to the front, the process units 60 are allowed to be removed upwardly for replacement.

According to the present embodiment configured as described above, the same advantageous effects as of the first embodiment can be achieved as well. Furthermore, in the present embodiment, the stroke of the LED units 50 can be made shorter than that which is required in the first embodiment, so that the multicolor and multifunction printer 1 can be miniaturized further.

Although some illustrative embodiments of the present invention have been described above, the present invention is not limited to these embodiments, and may be carried out into practice in various other ways. Thus, it is contemplated that various modifications and changes may be made to the illustrative embodiments of the invention without departing from the scope of the embodiments of the present invention as defined in the appended claims.

In the above-described embodiments, sheets P of paper, such as ordinary paper, cardboards, and postcards, are used as a recording sheet by way of example, but the present invention is not limited thereto; overhead transparency film sheets or cloth may be used instead.

In the above-described embodiments, the process unit 60 as adopted includes the photoconductor cartridge 67 containing the photoconductor drum 66, and the development cartridge 68 to be installed to the photoconductor cartridge 67, but the present invention is not limited thereto. For example, a process unit including an integral assembly of a photoconductor drum, a charger and a development cartridge may be used, instead.

In one of the above-described embodiments (i.e., the first embodiment), the output tray 55 is configured to be swingable upward and downward about the hinge portions 56 as shown in FIG. 1, but the present invention is not limited thereto. For example, the output tray 55 may be configured to be swingable upward and downward about a supporting axis located near the end at the rear side.

In one of the above-described embodiments (i.e., second embodiment), the output tray 55 is configured to be translated upward and downward by making use of the rotational motion produced by the motor (not shown), but the present invention is not limited thereto. For example, the apparatus may comprise a spring disposed at a lower end of the support rod 57, and a mechanism configured to keep the spring in a compressed state when the output tray 55 is closed (i.e., during the process of forming an image), wherein the output tray is allowed to be translated upward by releasing the compressed state of the spring.

In the above-described embodiments, the output tray 55 to which the LED units 50 (exposure units) are mounted is moved upward into the space S to cause the LED units 50 to be accommodated in the space S, but the present invention is not limited thereto. For example, the upper surfaces of the exposure units may be configured to make up parts of the output tray, and the exposure units themselves may be configured to be moved (swung or translated) upward and downward.

In the above-described embodiments, the process units 60 (process section 6) are allowed to be pulled out toward the front, but the present invention is not limited thereto. For example, the transfer section 7 (driving roller 71, driven roller 72, conveyor belt 73 and transfer roller 74) as well as the process section 6 may be allowed to be pulled out toward front. With this configuration, the transfer section 7 may also be handled for replacement and maintenance with increased ease.

In the above-described embodiments, the image forming apparatus includes four process units and four LED units (exposure units) corresponding to four colors of cyan, magenta, yellow and black, but the present invention is not limited thereto. That is, one or more aspects of the present invention are applicable to the other embodiments of the image forming apparatus comprising a plurality of, e.g., two, three, five or more process units and exposure units corresponding to the number of colors to be provided. In an illustrative embodiment where the image forming apparatus comprises two process units and two exposure units corresponding to two colors, the only one of the exposure units may be configured to be movable away from the process units.

The exposure units configured to expose the photoconductor drum to light, as consistent with the present invention, are not limited to the LED units which use light-emitting diodes as a light source for forming an electrostatic latent image on a photoconductor as in the above-described embodiments; electroluminescent (EL) devices, or other devices using luminescent material may be employed, instead.

In the above-described embodiments, each exposure unit (LED unit) includes a plurality of LEDs (luminescent elements) by way of example; however, a single luminescent element such as an LED may suffice to form a plurality of luminescent parts. For example, a backlight such as a fluorescent lamp or LED may be provided at the back of optical shutters made of a liquid crystal or PLZT material and arranged in an array. That is, the use of one luminescent element (light source) and an array of optical shutters in combination can form a plurality of luminescent parts arranged in an array. The luminescent parts of each exposure unit may not necessarily be arranged in one array, but may be arranged in two or more arrays.

What is claimed is:

1. An image forming apparatus comprising:

a plurality of process units arranged in tandem, each process unit including a photoconductor drum;

a plurality of exposure units, each of which is disposed above and opposite to the corresponding photoconductor drum and is configured to expose the photoconductor drum to light;

an output tray disposed above the plurality of exposure units, and configured to receive an ejected recording sheet on which an image has been formed; and an image reader unit disposed above the output tray with a predetermined space provided between the image reader unit and the output tray, and configured to read an image of a source document, wherein all of the exposure units are translationally movable together with the output tray upward and downward between a first position in which the exposure units are allowed to expose the photoconductor drums to light and a second position in which the plurality of exposure units are entirely accommodated in the predetermined space and the plurality of process units are allowed to be pulled out in a direction of tandem arrangement thereof, and wherein a distance between the image reader unit and the output tray varies in accordance with the movement of the plurality of exposure units between the first position and the second position.

2. An image forming apparatus according to claim 1, further comprising a conveyor roller configured to eject a recording sheet on which an image has been formed into the output tray, the conveyor roller being immovable irrespective of translation motion of the output tray.

3. An image forming apparatus according to claim 1, further comprising a conveyor roller configured to eject a recording sheet on which an image has been formed into the output tray, wherein the output tray located in the second position is at a level lower than that of the conveyor roller.

4. An image forming apparatus comprising:

a plurality of process units arranged in tandem, each process unit including a photoconductor drum;

a plurality of exposure units, each of which corresponds to the photoconductor drum and is configured to expose the photoconductor drum to light;

an output tray disposed above the plurality of exposure units, and configured to receive an ejected recording sheet on which an image has been formed; and an image reader unit disposed above the output tray with a predetermined space provided between the image reader unit and the output tray, and configured to read an image of a source document, wherein all of the exposure units are translationally movable together with the output tray between a first position in which the exposure units are allowed to expose the photoconductor drums to light and a second position in which the plurality of exposure units are entirely accommodated in the predetermined space, and wherein a distance between the image reader unit and the output tray varies in accordance with the movement of the plurality of exposure units between the first position and the second position.

5. The image forming apparatus of claim 4, wherein, when the exposure units are in the second position, the plurality of process units are able be pulled out in a direction of tandem arrangement thereof.

* * * * *